US006990299B2

(12) United States Patent
Kataoka

(10) Patent No.: US 6,990,299 B2
(45) Date of Patent: Jan. 24, 2006

(54) IMAGE FIXING DEVICE WITH PHASE CONTROLLED HEATERS

(75) Inventor: Tatsuhito Kataoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/643,930

(22) Filed: Aug. 20, 2003

(65) Prior Publication Data

US 2004/0086294 A1 May 6, 2004

Related U.S. Application Data

(62) Division of application No. 10/013,356, filed on Dec. 13, 2001, now Pat. No. 6,654,572.

(30) Foreign Application Priority Data

Dec. 14, 2000 (JP) ..... 2000-380165

(51) Int. Cl.
*G03G 15/20* (2006.01)

(52) U.S. Cl. ..... 399/69; 219/216

(58) Field of Classification Search ..... 399/69, 399/67, 88, 330, 328; 219/216, 485, 486, 219/497, 501; 307/38, 41
See application file for complete search history.

(56) References Cited

U.S. PATENT DOCUMENTS

| | | | | |
|---|---|---|---|---|
| 4,920,252 A | | 4/1990 | Yoshino | 219/497 |
| 5,359,178 A | | 10/1994 | Kotani et al. | 219/486 |
| 5,627,628 A | | 5/1997 | Soda et al. | 399/46 |
| 5,937,230 A | | 8/1999 | Iwase et al. | 399/69 |
| 5,978,618 A | | 11/1999 | Yamamoto et al. | 399/69 |
| 5,994,671 A | | 11/1999 | Suzuki et al. | 219/216 |
| 6,301,454 B1 | * | 10/2001 | Nishida et al. | 399/69 |
| 6,654,572 B2 | * | 11/2003 | Kataoka | 399/69 |
| 2002/0061202 A1 | * | 5/2002 | Kataoka | 399/69 |

FOREIGN PATENT DOCUMENTS

| | | | |
|---|---|---|---|
| JP | 58-134655 A | * | 8/1983 |
| JP | 59-205627 | | 11/1984 |
| JP | 7-271238 | | 10/1995 |
| JP | 9-146422 | | 6/1997 |
| JP | 2000-268939 | * | 9/2000 |

* cited by examiner

*Primary Examiner*—Sophia S. Chen
(74) *Attorney, Agent, or Firm*—Fitzpatrick, Cella, Harper & Scinto

(57) ABSTRACT

An image fixing apparatus has a first rotatable member heated by a first heater and a first temperature detecting element for detecting its temperature; a first controller for controlling electric supply to the first heater to maintain a detected temperature of the first temperature detecting element at a first target temperature; a second rotatable member heated by a second heater and forming a fixing nip with the first rotatable member; a second temperature detecting element for detecting a temperature of the second rotatable member, a second controller for controlling electric supply to the second heater to maintain the detected temperature of the second temperature detecting element at a second target temperature; and a phase controller for controlling electric energy supply phase so as to avoid overlapping of a phase of an electric power supply to the first heater and a phase of an electric power supply to the second heater.

4 Claims, 8 Drawing Sheets

IMAGE FIXING DEVICE WITH PHASE CONTROLLED HEATERS

This is a divisional of U.S. patent application Ser. No. 10/013,356, filed Dec. 13, 2001 U.S. Pat. No. 6,654,572, and allowed on Jul. 22, 2003.

FIELD OF THE INVENTION AND RELATED ART

The present invention relates to an image fixing device for fixing an unfixed image, which is usable with an image forming apparatus such as a copying machine or a printer.

In a conventional transfer type electrophotographic machine, for example, a toner image is transferred from a photosensitive drum onto a transfer material, and the transfer the image is subjected to a heat pressing process using a fixing heat roller with the use of a temperature sensor in the form of a thermister or the like.

Generally, the heating means for the heat roller is in the form of a halogen heater.

Recently, in order to stably fix toner on the transfer material in a high speed color image forming apparatus, it is considered that both of the fixing rollers contain heaters which are temperature controlled. However, it becomes necessary that electric power supply to the halogen heaters which are used as the heating means for the heat rollers are significantly increased in the speed-up of the image forming apparatus. The halogen heater involves a property that upon the start of the electric power supply to the heating means, a large inrush current flows with the possible result of temporary voltage drop of the commercial voltage source.

Therefore, the measurement has been taken against the inrush current by a phase control or the like to reduce the electric energization angle of the TRIAC, the thyristor, the SSR or the like for controlling the heating means for a period of the ten or more cycles during which the inrush current influences the frequency of the commercial voltage source.

However, if a plurality of heating means are provided for a plurality of heat rollers, and the phase control is carried out sequentially, unwanted radio noise is produced upon the switching actions of the TRIAC, the thyristor, the SSR or the like.

SUMMARY OF THE INVENTION

Accordingly, it is a principal object of the present invention to provide an image fixing device in which the inrush current to the heater is reduced. It is another object of the present invention to provide an image fixing apparatus in which the generation of radio noise is controlled. According to an aspect of the present invention, there is provided an image fixing apparatus comprising a first rotatable member for being heated by a first heater; a first temperature detecting element for detecting a temperature of said first rotatable member; first control means for controlling electric energy supply through said first heater so as to maintain a detected temperature of said first temperature detecting element at a first target temperature; a second rotatable member for being heated by said second heater, said second rotatable member constituting a fixing nip with said first rotatable member; a second temperature detecting element for detecting a temperature of said second rotatable member; a second control means for controlling electric energy supply to said second heater so as to maintain the detected temperature of said second temperature detecting element at a second target temperature; and phase control means for controlling electric energy supply phase so as to avoid overlapping of a phase of an electric power supply to said first heater and a phase of an electric power supply to said second heater.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to the preferred Embodiments of the present invention in conjunction with accompanying drawings.

Figure 1:
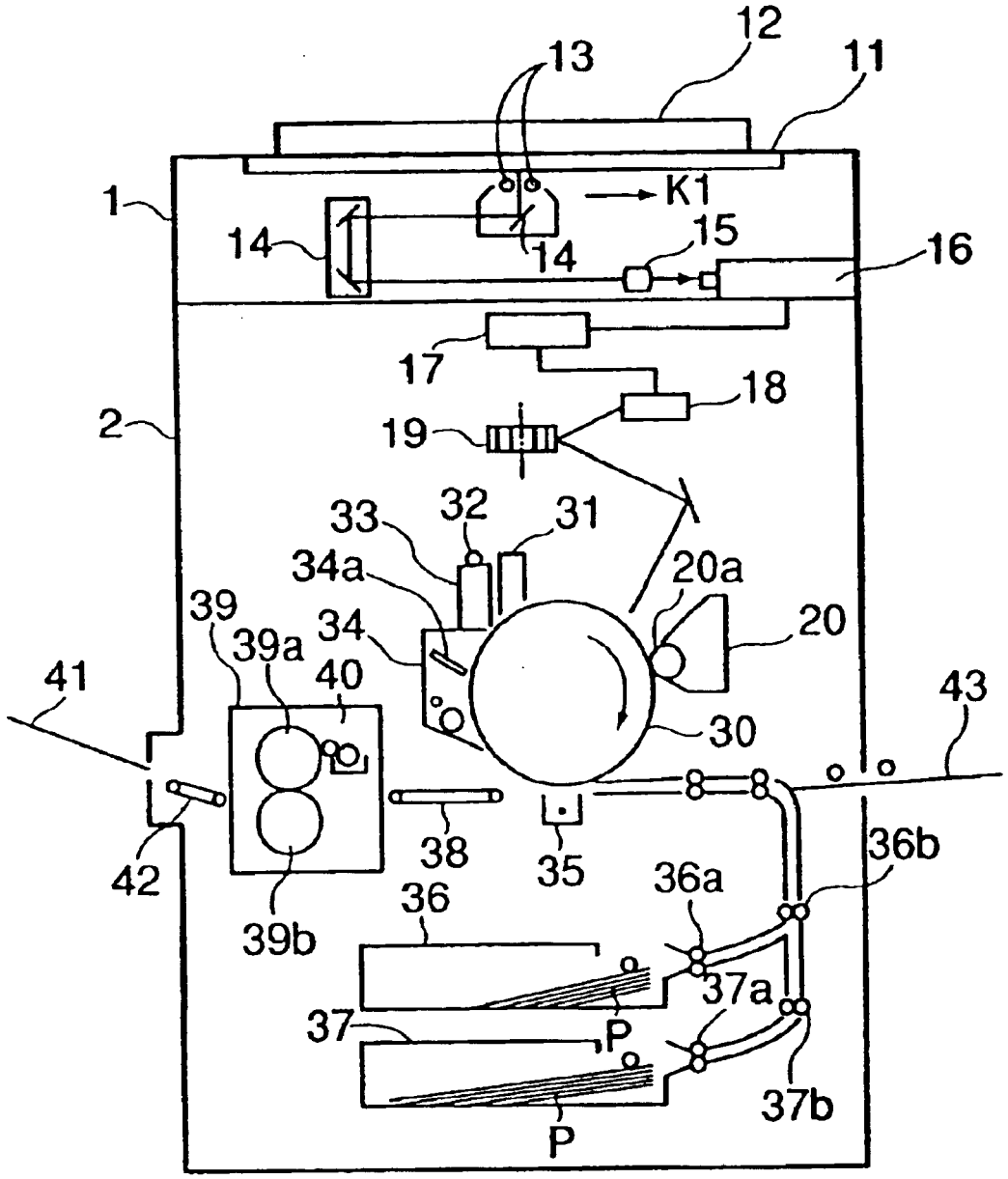
FIG. 1 is a schematic longitudinal sectional view of an image forming apparatus according to an embodiment of the present invention.

FIG. 1 is a schematic illustration of a digital image forming apparatus which is an exemplary image forming apparatus according to an embodiment of the present invention. The structure and operation thereof will first be described.

The image forming apparatus shown in this Figure comprises a reader portion 1 at an upper position of the main assembly of the apparatus and a printer portion 2 at a lower position thereof.

The reader portion 1 includes, as major constituent elements, an original carriage 11 for placing an original, an original pressing plate 12 for covering and pressing the top of the original, a light source 13 for illuminating an image surface of the original, a lens 15 and a plurality of mirrors 14 for properly directing the reflected light from the image surface, an image processing/photoelectric transducer 16 for image processing of the electric signal provided by photoelectric conversion of the reflected light by a CCD. The image processor 16 includes unshown CCD, A/D conversion, S/H, shading correction, masking correction, variable magnification, LOG conversion or the like functions for image formation.

The operation of the reader portion 1 having the above-described structure will be described. The original is placed facedown on the original carriage 11, and the original is pressed by the original pressing plate 12. The light source 13 moves in the direction indicated by an arrow K1, scanning the image surface of the original.

The light image reflected by the image surface is image on the CCD by way of the plurality of mirrors 14 and lenses 15. The light image is subjected to the photoelectric conversion. The image signal now in the form of an electric signal is supplied to an image processor 16 in which various image processing operations are performed, and the processed several is supplied to the printer portion 2.

As shown in FIG. 1, the printer portion 2 comprises as major constituent elements an image controller 17 for converting an electric signal supplied from the reader portion 1 to a signal for actuating the laser, a laser element 18, a polygonal scanner 19 for scanning the surface of the photosensitive drum with the laser beam, an image formation station including a photosensitive drum which will be described hereinafter and a fixing device (fixing unit) 39 disposed at the most downstream position.

The image formation station comprises the photosensitive drum 30 supported for rotation in the direction indicated by the arrow, a charger 31 for uniformly charging the surface of the photosensitive drum 30, a developing device 20 for developing an electrostatic latent image on the photosensitive drum 30, a transfer charger 35 for transferring the toner image from the photosensitive drum 30 onto the transfer material P, a cleaner 34 for removing the untransferred toner from the photosensitive drum 30, a cleaner blade 34*a*, an assistance charger 33 for discharging of the photosensitive drum 30, and preexposure lamp 32 for removing the residual charge. These elements are disposed in this order around the surface of the photosensitive drum 30 in the direction of the peripheral movement thereof.

The developing device 20 includes a developing roller 20*a* which is rotated in the opposite peripheral direction with respect to the photosensitive drum 30 to develop the toner image on the photosensitive drum 30.

The transfer material P now having the toner image transferred thereto is fed to the fixing device 39 by the belt 38, and in the fixing device 39, the fixing rollers 39*a*, 39*b* are rotated to feed the transfer material P and fix the toner image on the transfer material by heat and pressure. Finally, the transfer material P after being subjected to the image fixing operation is discharged onto a sheet discharge tray 41 provided outside the main assembly of the operators by a conveyer belt 42.

A sheet feeding station for feeding the transfer material P includes a feeding path for the transfer material P, and includes sheet feeding devices at the most upstream position with respect to the feeding direction of the transfer material P, the sheet feeding device including sheet feeding cassettes 36, 37, sheet feeding rollers 36*a*, 37*a*, and feeding rollers 36*b*, 37*b*.

In addition, there is provided a multi-sheet feeding device 43. From the multi-sheet feeding device 43, various unusual transfer material P having different material, size and the nature can be fed to the image formation station, sees the paper feeding path therefrom is relatively straight.

Figure 2:
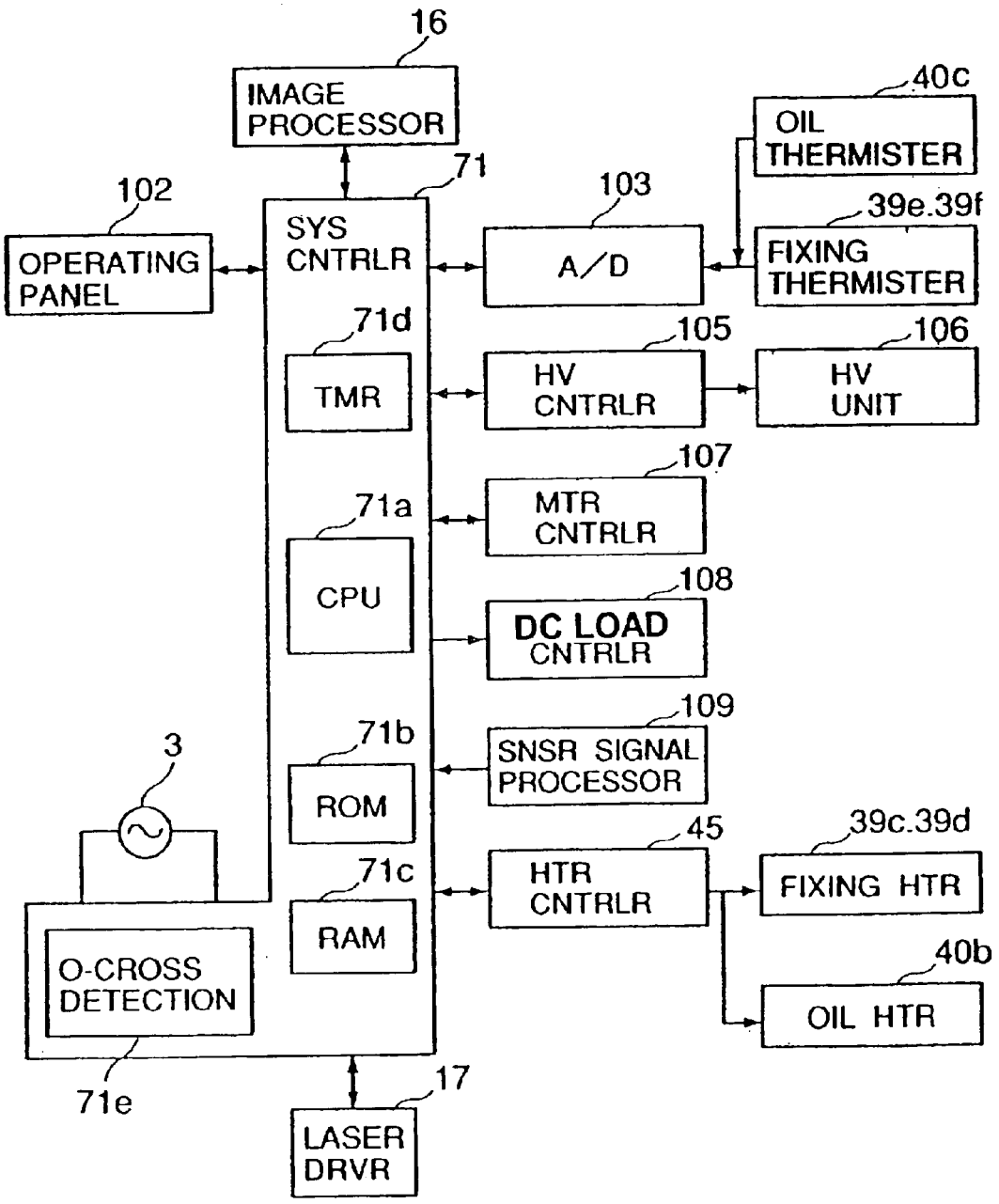
FIG. 2 is a block diagram showing an example of a controlled system for the copying machine shown in FIG. 1.

FIG. 2 shows a block diagram of a control system for this apparatus. The apparatus is entirely controlled by a system controller 71. The system controller 71 controls actuations of various loads, information collection and analysis of various sensors, the image processor 16, the laser actuator 17 and data exchange by the operating portion 102, that is, the user interface. The system controller 71 comprises a CPU 71*a* for performing the above-described functions, and the CPU 71*a* executes the sequential operations through a predetermined image formation sequence in accordance with a program stored in the ROM 71*b* in the system controller 71. It also comprises a RAM 71*c* for storing rewritable data which are to be stored temporarily or permanently and a timer 71*d*. RAM 71*c* stores a high voltage set point to a high voltage controller 105 which will be described hereinafter, various data which will be described hereinafter, image formation instructions information from the operating portion 102 and the like.

The description will be made as to the data exchange among the image processor 16, the laser controller 17 and the operating portion 102, which is the first function of the system controller 71. The image processor 16 performs functions such as an A/D conversion of the image signal from an unshown CCD, the S/H, the shading correction, masking correction, the variable magnification, the LOG conversion and the like as described hereinbefore, and the like.

In addition to producing set point data according to specifications of various parts operated for image processing, it receives various signals such as original image density signals and sets various values for proper image formation by controlling the high voltage controller 105 and the laser controller 17 which will be described hereinafter.

The image controller 17 effects proper setting of the laser in accordance with the image size to be formed and the digital video data having been subjected to the image processing, that is, the setting necessary for the PWM process of the laser emission.

From the operating portion 102, the information of the copying magnification and the density set level set by the user and the, is obtained, and in addition, the operating portion 102 produces, for the user, information of the state of the image forming apparatus, namely, the information of the number of image formations, the occurrence of jamming, the place where the jamming occurs, and the like.

The description will be made as to the second function including actuations of various loads in the apparatus and information collection and analysis of the sensors. In the apparatus, there are provided a DC load such as a motor, clutch/solenoid or the like, and sensor as such as a photo-interruptor, a micro-switch one like. By properly actuating the motor and the DC load, the transfer material is fed, and various units are actuated, and various sensors monitor their operations. The system controller 71 controls various motors by the motor controller 107 on the basis of the signals from various sensors 109, and simultaneously performs the image forming operation by actuating the clutch/solenoid by the DC load controller 108.

By supplying various high voltage control signals to the high voltage controller 105, the primary charger 31, the assistance charger 33, the transfer charger 35 and the developing roller 20*a* which are charger constituting the high voltage unit 106, are supplied with appropriate high voltages.

In addition, in the fixing rollers 39*a*, 39*b* in the fixing device 39, there are provided heaters 39*c*, 39*d* for heating the rollers, and an oil heater 40*b* for heating the oil to be applied on the fixing roller. The heaters are subjected to the ON/OFF control by the heater controller 45.

There are provided thermisters 39*e*, 39*f* for measuring temperatures of the fixing rollers 39*a*, 39*b*, and a thermister 40*c* for measuring a temperature of the oil heater 40*b*. The resistance value changes of the thermisters in accordance with the temperature changes of the fixing rollers 39*a*, 39*b* and the oil heater 40*b* are converted to voltages, which are inputted to the system controller 71 as digital values. On the basis of the temperature data, the heater controller 45 is operated.

The system controller 71 is provided with a zero-cross detector 71*e* for detecting zero-cross of the voltage of the commercial power source 3, and a trigger signal for controlling made electric power to be supplied to the electric energizations heater 39*c*, 39*d* for heating a roller.

Figure 3:
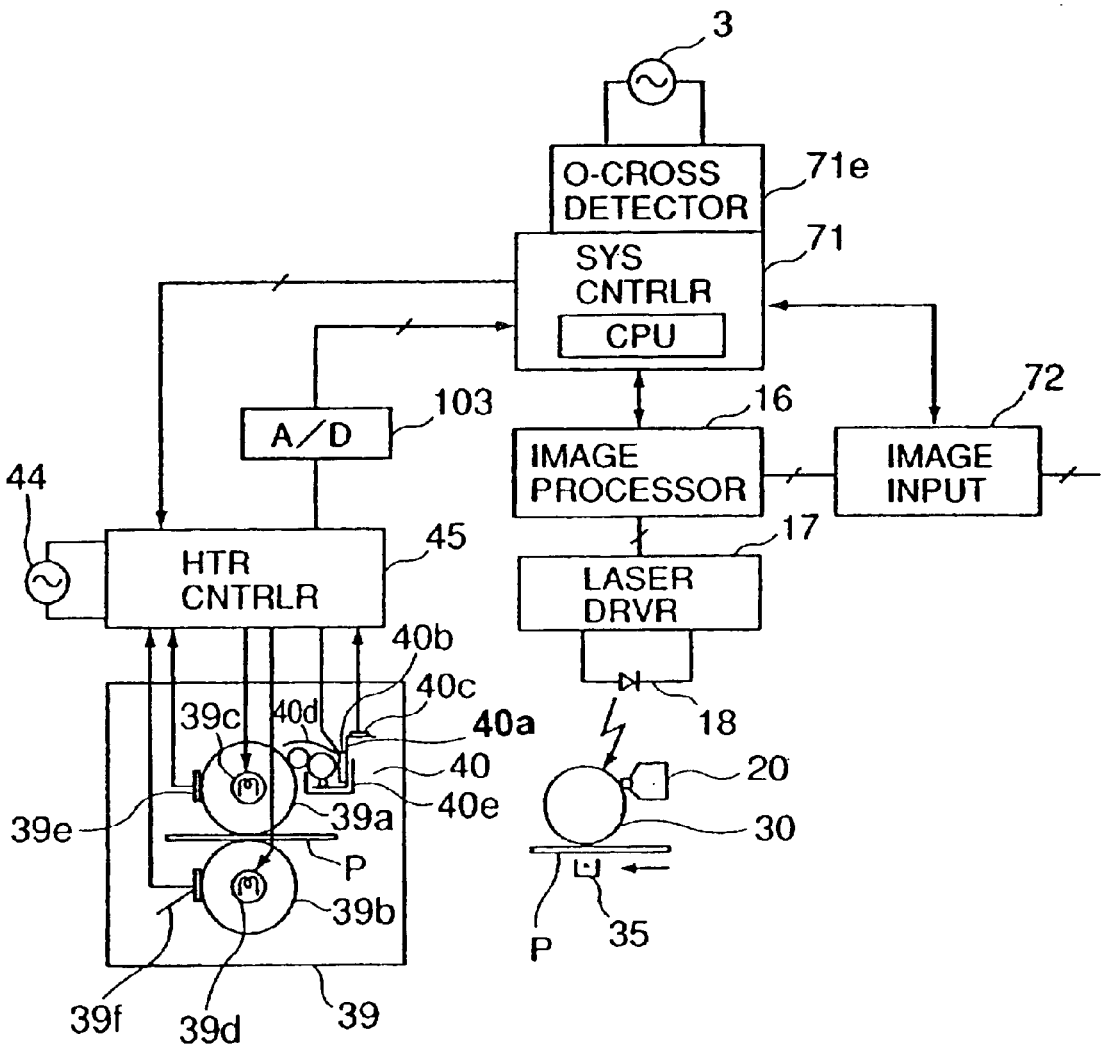
FIG. 3 is a block diagram of examples of a printer control system and a fixing unit for the copying machine shown in FIG. 1.

FIG. 3 is a block diagram of the image forming apparatus described in the foregoing. The block diagram shows a system for image formation on the transfer material P and the optimum image fixing. The system controller 71 functions to effect various controls for the various, and the CPU therein controls the entire system.

In the Figure, designated by 72 is an image input portion constituting a part of a reader portion 1; 16 is an image processor; 17 is a laser actuator for modulation and actuation of the semiconductor laser on the basis of the image data; and 18 is a semiconductor laser (laser element) actuated by a laser actuator 17.

Designated by 30 is a photosensitive drum on which the electrostatic latent image is formed by the output light of the semiconductor laser 18; 20 is a developing device for developing the latent image formed on the photosensitive drum 30; and 35 is a transfer charger for transferring the toner image from the photosensitive drum 30 onto the transfer material P. Designated by 39 is a fixing device for fixing the toner image on the transfer material P by heating and pressing.

Referring to FIG. 3 which is a block diagram, the structures around the fixing device in the image forming apparatus will be described. In the fixing rollers 39*a*, 39*b*, there are provided halogen heaters 39*c*, 39*d* for heating the roller. As described in the foregoing, the heaters are subjected to ON/OFF control for each of the heaters by the system controller 71 through the heater controller 45.

The heaters is ON/OFF-controlled on the basis of the respective temperatures detected by the thermisters 39*e*, 39*f* contacted to the respective rollers so as to maintain the predetermined temperature.

The fixing device 39 is provided with an oil application unit for applying silicon oil for the purpose of improvement in the parting property between the upper fixing roller 39*a* and the transfer material P.

The oil application unit comprises an oil sump 40*e* for containing oil, an oil heater 40*b* for oil temperature adjustment to maintain a constant oil viscosity, a heater mounting metal plate 40*a* for transmitting the heat from the oil heater to the silicon oil, an oil thermister 40*c* for measuring the temperature of said oil heater, an oil application roller 40*d* for applying a proper amount of oil to the upper fixing roller.

The oil heater 40*b*, similarly to the temperature control for the fixing roller, is ON/OFF-controlled by the system controller 71 through the heater controller 45.

The heater is ON/OFF-controlled on the basis of the temperature measured by the thermister 40*c* for the temperature monitor, mounted to the oil heater 40*b* so as to maintain the predetermined temperature.

The heater controller is connected with a primary voltage source 44 for supplying primary side electric power to each of the heaters, and the electric energy supply is ON/OFF-controlled by a SSR in the heater controller 45. The signal from each of the thermisters is directly inputted to the system controller 71 through the heater controller 45, and simultaneously, the heater controller 45 effects of the abnormality detection for the thermisters. The, the abnormal output resulting from disconnection in the thermister, an abnormality temperature detection or the like is detected, and the signal indicative of the abnormality is supplied to the system controller 71.

Figure 4:
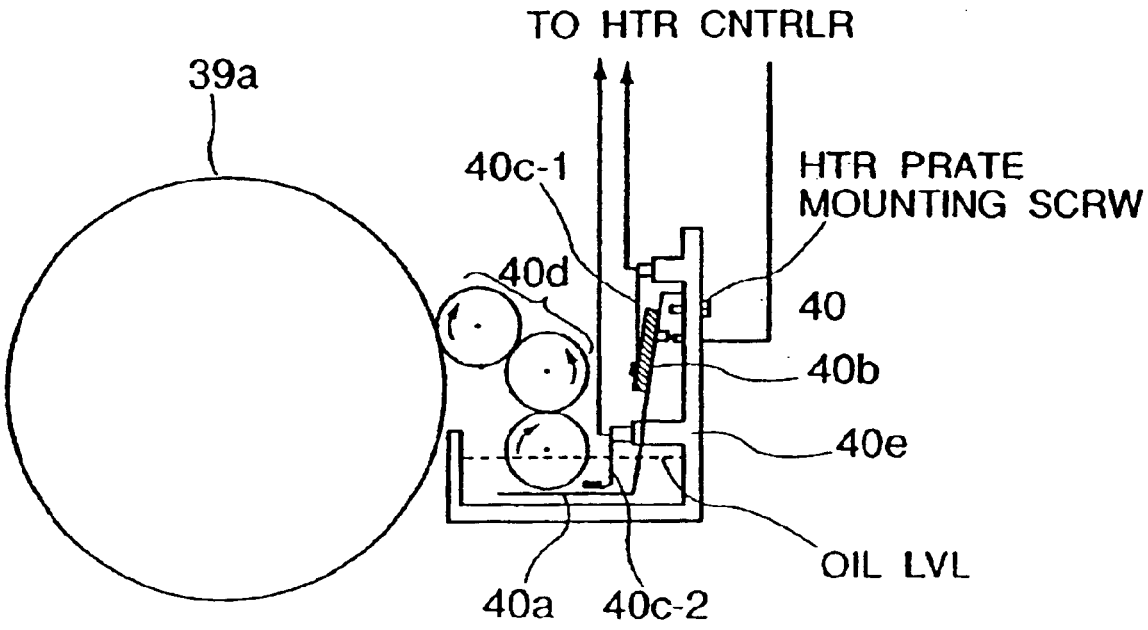
FIG. 4 is a block diagram showing an example of an oil application system for the fixing unit shown in FIG. 3.

Referring to FIG. 4, the oil applying unit 40 in the fixing device 39 will be described in detail. The oil applying unit 40, as described hereinbefore, includes the oil heater mounting metal plate 40*a*, the oil heater 40*b*, the oil application roller 40*d*, the oil pan 40*e* and two thermisters 40*c*-1, 40*c*-2 for oil temperature monitoring.

The oil sump 40*e* is filled with the silicon oil up to the level indicated by the chain line, but a rotational oil application roller 40*d* in the direction indicated by the arrow, a proper amount of the oil is applied to the upper fixing roller 39*a*.

The lower portion of the oil heater mounting metal plate 40*a* is in the silicon oil, and the oil heater 40*b* is mounted to the portion above the oil level. By this, the oil can be heated with a relatively inexpensive structure without using an expensive heater having an anti oil property, and the oil is heated indirectly through the heater mounting metal plate 40*a*.

The oil temperature detecting means comprises an oil temperature detection thermister 40*c*-2 which is in the oil and directly detects the temperature of the oil and a thermister 40*c*-1 for detecting the oil heater temperature for detecting the temperature of the oil heater.

Figure 6:
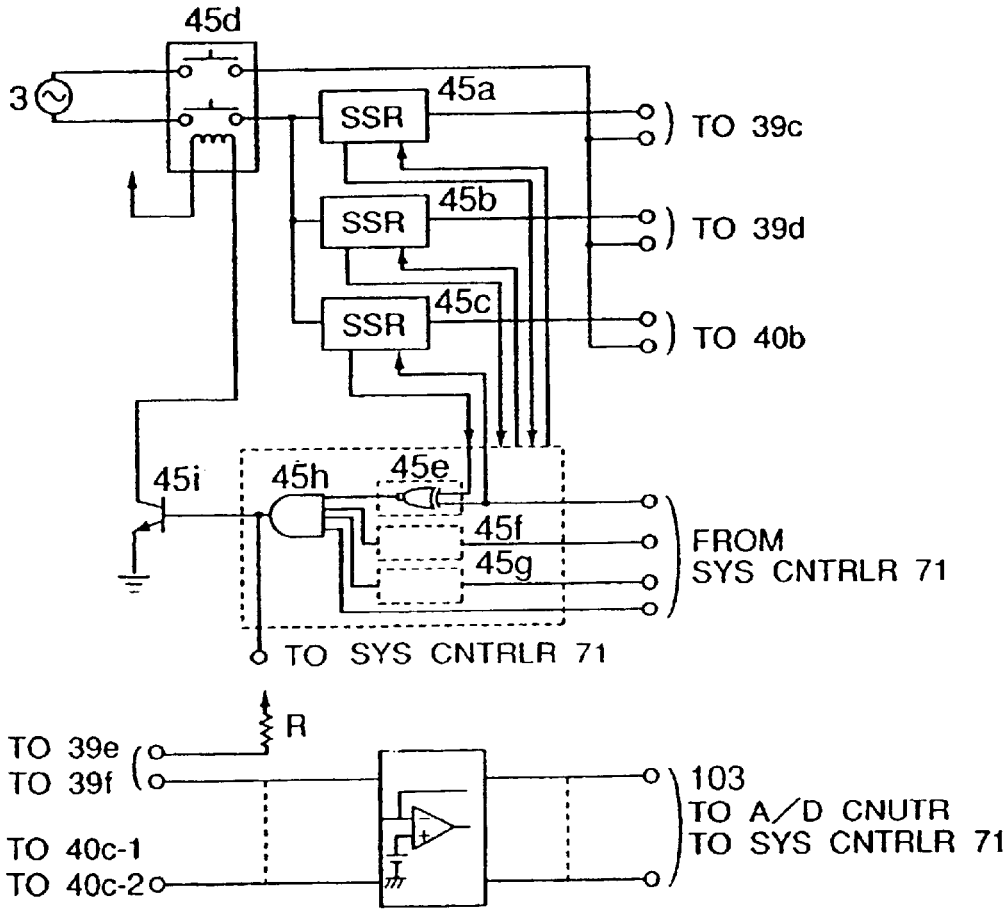
FIG. 6 is a block diagram showing an example of a heater controller for the fixing unit shown in FIG. 3.

Referring to FIG. 6, the internal structure of the heater controller 45 will be described. The heater controller 45 effects the ON/OFF control for each of the heaters, and the ON/OFF of the primary voltage source for supplying the electric energy to the heaters through SSR (solid state relay) 45*a*, 45*b*, 45*c*.

The signal for controlling the SSR is supplied from the system controller 71. From the SSR, a state signal indicative of whether the SSR effects the supply from the primary voltage source is produced. If so, the signal level is "H", and if not the signal level is "L".

Then, the state signal is supplied to the SSR abnormality detecting circuit 45*e*, 45*f* and 45*g*, respectively. It is compared with the control signal (it is ON when the level is "H", and it is OFF when the level is "L") from the system controller 71. If there is a discrepancy between the control signal from the system controller 71 and the state signal, for example, if the event is detected in which the SSR is in the conductive state despite the OFF signal produced by the system controller, the abnormality in the SSR is detected.

The abnormality detection signal and the detection signal output are inputted into an AND gate, so that at least one of the signals is indicative of the abnormality, the electric energy supply to the SSR is stopped.

In addition, a signal for forcing the electric energy supply to the SSR to stop, is also supplied from the system controller 71.

Between the SSR and the electric energy supply source, that is, the primary voltage source, a relay 45*d* is provided such that upon the abnormality, a transistor 45*i* is rendered OFF by an output of the element 45*h*, by which the relay is rendered OFF, and therefore, the electric energy supply is stopped.

Each of the thermisters 39*e*, 39*f*, 40*c*-1, 40*c*-2 are pulled up by a resistance R to detect the change in the resistance value in accordance with the temperature as a change of the voltage. The temperature data converted to the voltage is sent to an A/D103 and is processed by the system controller 71, and simultaneously, is compared with the predetermined voltage, and the result of comparison is fed to the system controller 71. When the detected temperature by each of the thermisters, exceeds a predetermined temperature (largely different from the target temperature), it is discriminated that some abnormality occurred in the thermister, and the event is transmitted to the system controller 71.

In the Figure, the abnormality temperature detecting circuit is designated by a reference numeral 45*j*, and the set voltages are peculiar to the respective thermisters.

Figure 5:
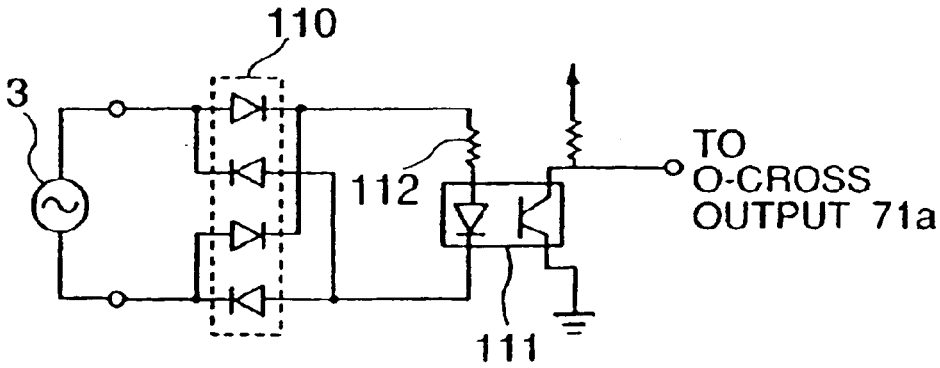
FIG. 5 is a block diagram showing an example of a zero-cross detection circuit provided in the system controller shown in FIG. 1.

Referring to FIG. 5, the structure for detecting the zero-cross of the commercial power source will be described. FIG. 5 shows an inner structure of the zero-cross detection 71*e*. The commercial power source 3 is subjected to a full-wave rectification 110, and actuates a photo-coupler 111 through a resistance 112.

The LED side of the photo-coupler 111, the full-wave-rectified current flows from the commercial power source. The LED is so constructed that it does not or hardly emit light by the pulsating flow of the full-wave rectification, that is, adjacent 0V.

As a result, the collector is pulled up at 5V at the transistor side of the photo-coupler 111, and therefore, it produces "H" adjacent a zero-cross point of the voltage of the commercial power source 3 and produces "L" otherwise. The timing of the zero-cross point is supplied to the CPU 71*a* in the system controller 71.

Figure 7:
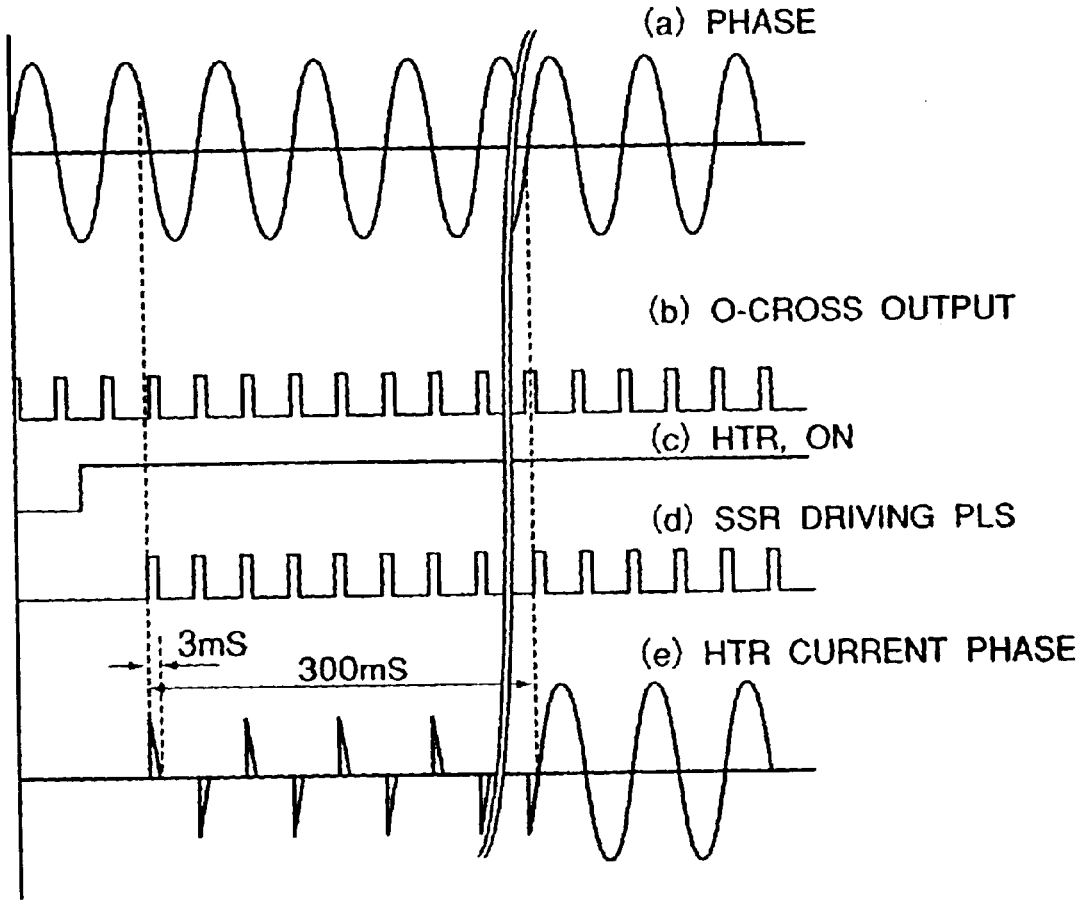
FIG. 7 is a graph of a driving signal for SSR for supplying electric power to the heater.

Referring to FIG. 7, the description will be made as to the zero-cross control. In the Figure, (a) shows a voltage waveform of the commercial power source 3. As described in the foregoing, the zero-cross signal of the commercial power source 3 is detected by the zero-cross detection 71*e*, (b) in the Figure shows the result of the detection. In the figure, (c) shows heater ON signal which is "H" during the period in which the heaters 39*c*, 39*d* are to be energized.

In this embodiment, the heat roller heating means is a halogen heater, and the halogen heater has such property that a large inrush current flows at the actuation. A large inrush current flow may lead to deterioration of SSR for actuating the heater and a temporary voltage drop of the commercial power source, and there is the possibility that the apparatus and in addition the apparatus connected with the commercial power source might be adversely affected. In this apparatus, a phase control for reducing the electric energization angle to the SSR by pre-heating the halogen heater for 300 mS corresponding to ten and several cycles of the commercial power source in which the inrush current is large.

As regards the method of the phase control, the CPU 71*a* in the system controller 71 generates SSR driving pulses shown in (d) in this Figure on the basis of the zero-cross signal shown in (b) in the same Figure. The SSR driving pulse is a gate trigger signal of a TRIAC in the SSR, and when the CPU 71*a* detects the zero-cross signal (b) immediately after the timing at which the heater ON signal (c) becomes "H", the CPU 71*a* delays the signal so as to make the electric energization time 3 mS to reduce the electric energization angle of the SSR. The operation is carried out for 300 mS, and thereafter, the pre-heating operation is terminated, and the settings are shifted to the normal zero-cross electric power supply. In the Figure, (e) shows the phase of the heater electric energizing current.

As described in the foregoing, the phase control is carried out at the initial stage of the electric energization to the halogen heaters 39*c*, 39*d* for the image fixing the device, independently from each other to minimize the inrush currents.

When the phase control is effected to the halogen heater, the generation of radio noise by the switching of the SSR is a problem. Generally, the noise terminal voltage is the maximum adjacent the phase 90° of the phase, but the noise terminal voltage rises with an increase of the electric energy consumption of the heater, even where the electric energization angle is small.

The noise terminal voltage is large when a plurality of heaters are simultaneously actuated, and the phase control periods are overlapped with each other, similarly to the case of use of the heater consuming large electric power.

Normally, the noise terminal voltage is suppressed by using a noise filter or the like. When, however, it is large, the noise filter to be used has to have a very large constant even to such an extent that it is not implementable. In addition, it is very difficult to completely removed the noise terminal voltage.

Figure 8:
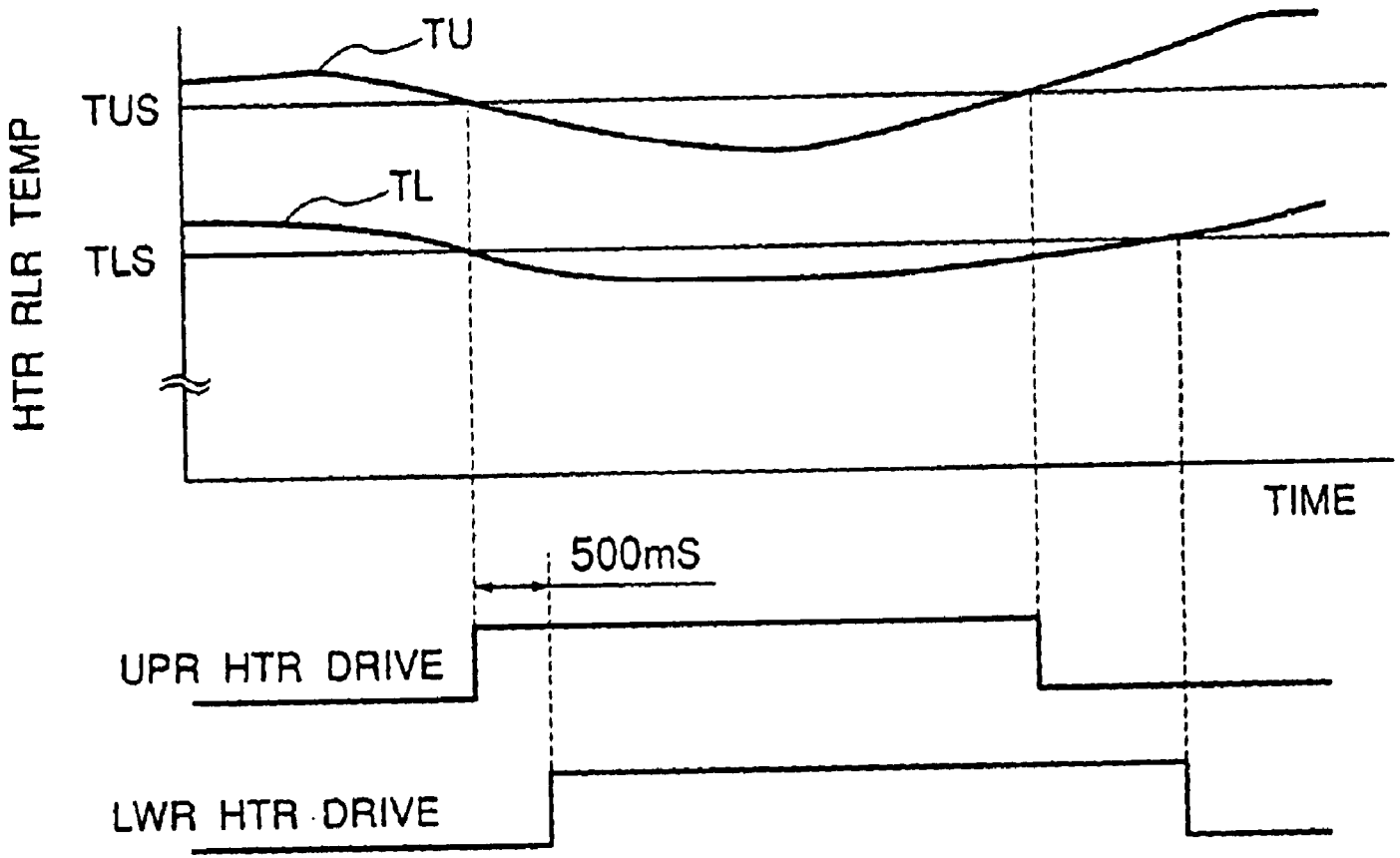
FIG. 8 shows a relation of a heater driving signal relative to the temperature of the heat roller.

In view of this, the control employed in this embodiment is such that start timings of the electric energization for the upper and lower halogen heaters are not overlapped with each other. Referring to FIG. 8, the structure will be described.

FIG. 8 shows a temperature changes of the upper lower heat roller temperatures TU, TL and corresponding to driving signals for the heaters. Designated by TUS, TLS are threshold temperatures at which the heaters are actuated or deactivated. When the temperatures are higher than TUS, TLS, the heater is OFF, and when it is lower than that, the heater is ON. When both of the temperatures of the upper and lower heat rollers, are lower than TUS, TLS, the upper and lower heaters are simultaneously actuated, normally. This, however, would result in overlapping of the phase controls for the heaters and would result in the above-described problem of the noise terminal voltage.

According to this invention, under the condition that operating lower heaters would be actuated simultaneously, the heater driving signal for the lower heater is started 500 mS later, thus delaying the signal beyond the phase control period. The delay period of 500 mS is determined in terms of the thermal capacity of the heat roller per se and the heat quantity removed by the passing of the transfer material, and it is determined so as not to produce a temperature hunting of the heat roller in the temperature control.

Figure 9:
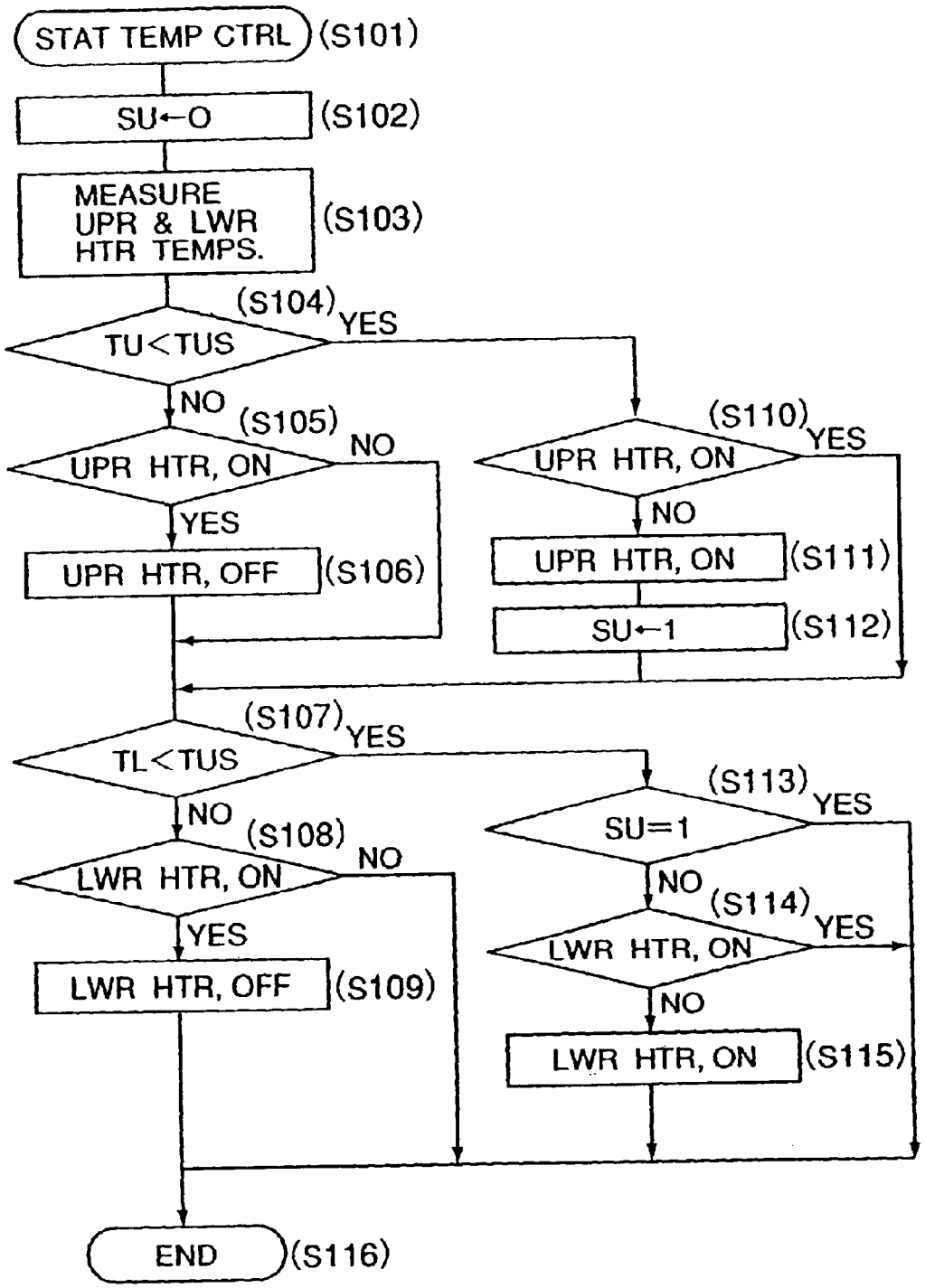
FIG. 9 is a flow chart showing a process of control for the actuation of the heaters.

The control operations are controlled by the system controller 71, and the algorithm of the heater control will be described in conjunction with FIG. 9. FIG. 9 shows an algorithm for the heater control of the heat roller, and in the sequential operations are carried out at the regular intervals of 500 mS.

When the temperature control starts (step S101), the upper heater ON status SU is reset (S102). Then, the temperatures of the upper and lower heat rollers are sensed by the thermisters 30*e*, 39*f* (S103).

First, the discrimination is made as to whether or not the temperature TU of the upper heat roller exceeds the threshold temperature TUS (S104). If so, the discrimination will be made as to whether or not the upper heat roller is ON at that time (S105). If so, the upper heat roller is rendered OFF (S106).

If the result of the discrimination means that temperature TU of the upper heat roller is lower than the threshold temperature TUS, the discrimination is made as to whether or not the upper heat roller is ON (S110). If not, the upper heat roller is actuated (S111), and sets the heater ON status SU (S112). Then, the discrimination is made as to whether or not the temperature TL of the lower heat roller exceeds the threshold temperature TLS (S107). When the temperature TL of the lower heat roller exceeds the threshold temperature TLS, discrimination will be further made as to whether or not the lower heat roller is ON (S108). If so, the lower heat roller is deactivated (S109).

If the temperature TL of the lower heat roller is lower than the threshold temperature TLS, the discrimination is further made as to whether or not the upper heater ON status SU is set (S113). If not, the discrimination is further made as to whether or not the lower heat roller is ON (S114). If not, the lower heat roller is rendered ON (S115).

When the upper heater ON status SU is set, the operation terminates (S116) in order to avoid the simultaneous actuation of the upper and lower heaters.

The lower heater is actuated in the sequential operation which is carried out 500 mS later.

Other Embodiments 1) in the first embodiment, the ON condition of the upper heater is given the first priority in order to prevent the simultaneous actuations of the heaters, the priority may be placed on the ON condition of the lower heater.

2) In the first embodiment, the phase control signal is generated as a digital signal by the CPU, but it may be generated through an analog system on the basis of the zero-cross signal.

3) The image forming means on the recording material is not limited to the transfer type electrophotographic process of the first embodiment, but may use a transfer type or a direct type electrostatic recording process, magnetic recording process or the like.

As described in the foregoing, according to the present invention, there is provided a heat pressing fixing device for fixing an image on the recording material by heat and pressure provided by the heat pressing rollers, or an image forming apparatus using the same, in which the electric power control is such that inrush current to the heater for the rollers is suppressed, and the proper temperature control is accomplished.

While the invention has been described with reference to the structures disclosed herein, it is not confined to the details set forth and this application is intended to cover such modifications or changes as may come within the purpose of the improvements or the scope of the following claims.

What is claimed is:

1. An image fixing apparatus, comprising:

a first rotatable member for being heated by a first heater to fix a toner image on a recording material;

first control means for controlling electric power supply to said first heater, said first control means effecting a phase control of the electric power supply upon start of the electric power supply;

a second rotatable member for being heated by a second heater to fix the toner image on the recording material;

second control means for controlling electric power supply to said second heater, said second control means effecting a phase control of the electric power supply upon the start of the electric power supply, wherein when temperature of said first rotatable member and said second rotatable member are lower than respective target temperatures, the phase control for the second heater is started after completion of the phase control for the first heater.

2. An apparatus according to claim 1, wherein said first and second control means effect the phase control on the basis of zero-cross timing of a commercial electric source.

3. An apparatus according to claim 2, wherein said first control means and said second control means reduce electric power supply angles in the phase control upon the start of the electric power supply.

4. An apparatus according to claim 1, wherein said first rotatable member and said second rotatable member form an image fixing nip.

* * * * *

UNITED STATES PATENT AND TRADEMARK OFFICE

CERTIFICATE OF CORRECTION

PATENT NO. : 6,990,299 B2
APPLICATION NO. : 10/643930
DATED : January 24, 2006
INVENTOR(S) : Tatsuhito Kataoka It is certified that error appears in the above-identified patent and that said Letters Patent is hereby corrected as shown below:

COLUMN 1:
Line 14, "machine," should read --copying machine,--.

COLUMN 4:
Line 39, "one" should read --and the--.
Line 50, "charger" should read --chargers--.

COLUMN 5:
Line 35, "is" should read --are--.
Line 48, "and" should read --and an--.

COLUMN 8:
Line 14, "removed" should read --remove--.
Line 21, "a" should be deleted.
Line 22, "and" should be deleted.

COLUMN 10:
Line 15, "material;" should read --material; and--.

Signed and Sealed this

Fifteenth Day of August, 2006

JON W. DUDAS
*Director of the United States Patent and Trademark Office*